US006634704B1

(12) United States Patent
Bergquist

(10) Patent No.: US 6,634,704 B1
(45) Date of Patent: Oct. 21, 2003

(54) PORTABLE SEATING DEVICE

(76) Inventor: Mark D. Bergquist, P.O. Box 7865, Mammoth Lakes, CA (US) 93546

( * ) Notice: Subject to any disclaimer, the term of this patent is extended or adjusted under 35 U.S.C. 154(b) by 0 days.

(21) Appl. No.: 10/164,781

(22) Filed: Jun. 7, 2002

(51) Int. Cl.[7] ..... A47D 1/62

(52) U.S. Cl. ..... 297/16.2; 297/344.18; 248/164; 108/118

(58) Field of Search ..... 297/16.2, 18, 24, 297/25, 26, 344.18; 248/164, 163.1, 425; 108/139, 23, 118, 147.21

(56) References Cited

U.S. PATENT DOCUMENTS

| | | | | | |
|---|---|---|---|---|---|
| 2,722,973 | A | | 11/1955 | Murcott | |
| 3,638,588 | A | | 2/1972 | Abbott | |
| 3,709,167 | A | | 1/1973 | Sprigman | |
| 3,923,280 | A | * | 12/1975 | Good | 248/405 |
| 4,118,064 | A | * | 10/1978 | Robeson | 297/18 |
| 4,266,748 | A | * | 5/1981 | Dalton | 248/425 |
| 4,733,911 | A | * | 3/1988 | Fulcheri | 297/395 |
| 4,852,836 | A | * | 8/1989 | Kawazoe | 248/168 |
| 4,934,638 | A | * | 6/1990 | Davis | 248/164 |
| 5,522,642 | A | * | 6/1996 | Herzog | 297/344.18 |
| 5,749,557 | A | * | 5/1998 | Chang | 248/405 |
| D396,569 | S | | 8/1998 | Chen | |
| 5,816,556 | A | * | 10/1998 | Liao | 248/405 |
| 5,851,052 | A | | 12/1998 | Gustafsson | |
| 5,876,091 | A | * | 3/1999 | Chernomashentsev | 297/16.2 |
| 5,921,621 | A | * | 7/1999 | Cook et al. | 297/16.2 |
| 6,135,557 | A | * | 10/2000 | Gustafsson | 297/344.18 |
| 6,467,843 | B1 | * | 10/2002 | Rossborough | 297/344.18 |

* cited by examiner

*Primary Examiner*—Peter M. Cuomo
*Assistant Examiner*—Stephanie Harris

(57) ABSTRACT

A portable seating device for providing a user with a small, collapsible stool that would be lightweight and portable. The portable seating device includes comprises a plurality of telescoping legs. A band is couplable to the plurality of legs to hold the medial portions of the telescoping legs together to permit spreading of top and bottom portions of the plurality of legs into a supporting position. A seat member is couplable to the top portions of the plurality of legs such that the seat member is held in a spread position when the plurality of legs are in the supporting position whereby the seat member is adapted for supporting a person sitting on the seat member. A line is coupled to the bottom portion of each of the plurality of legs to form a loop for preventing the bottom portions of the plurality of legs from spreading beyond the supporting position.

4 Claims, 4 Drawing Sheets

PORTABLE SEATING DEVICE

BACKGROUND OF THE INVENTION

1. Field of the Invention

The present invention relates to portable seating devices and more particularly pertains to a new portable seating device for providing a user with a small, collapsible stool that would be lightweight and portable.

2 Description of the Prior Art

The use of portable seating devices is known in the prior art. U.S. Pat. No. 3,709,167 describes a folding stool with legs and separate seat braces that extend from and are pivotally attached to a hub. Another type of portable seating devices is U.S. Pat. No. 4,934,638 describing a collapsible tripod stool. U.S. Pat. No. 5,851,052 describes a foldable stool that has a triangular shaped seat. U.S. Pat. No. Des. 396,569 describes a design of a cane-functioned collapsible chair. U.S. Pat. No. 2,722,973 describes a self opening collapsible stool. U.S. Pat. No. 3,638,588 describes a collapsible stool having a plurality of struts so that the legs and struts extend away from each other in diverging directions.

While these devices fulfill their respective, particular objectives and requirements, the need remains for a portable collapsible stool that can support a greater load than other similar types of portable stools.

SUMMARY OF THE INVENTION

The present invention meets the needs presented above by utilizing a wire that limits the distance the legs can be spread apart, thus strengthening the tripod.

An object of the present invention is to provide a new portable seating device that would be of lightweight construction making it idea for camping, hunting, fishing, spectator sports and parades.

Even still another object of the present invention is to provide a new portable seating device that would provide relief for aching feet, legs, and back muscles.

To this end, the present invention generally comprises a plurality of telescoping legs. A band is couplable to the plurality of legs to hold the medial portions of the telescoping legs together to permit spreading of top and bottom portions of the plurality of legs into a supporting position. A seat member is couplable to the top portions of the plurality of legs such that the seat member is held in a spread position when the plurality of legs are in the supporting position whereby the seat member is adapted for supporting a person sitting on the seat member. A line is coupled to the bottom portion of each of the plurality of legs to form a loop for preventing the bottom portions of the plurality of legs from spreading beyond the supporting position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
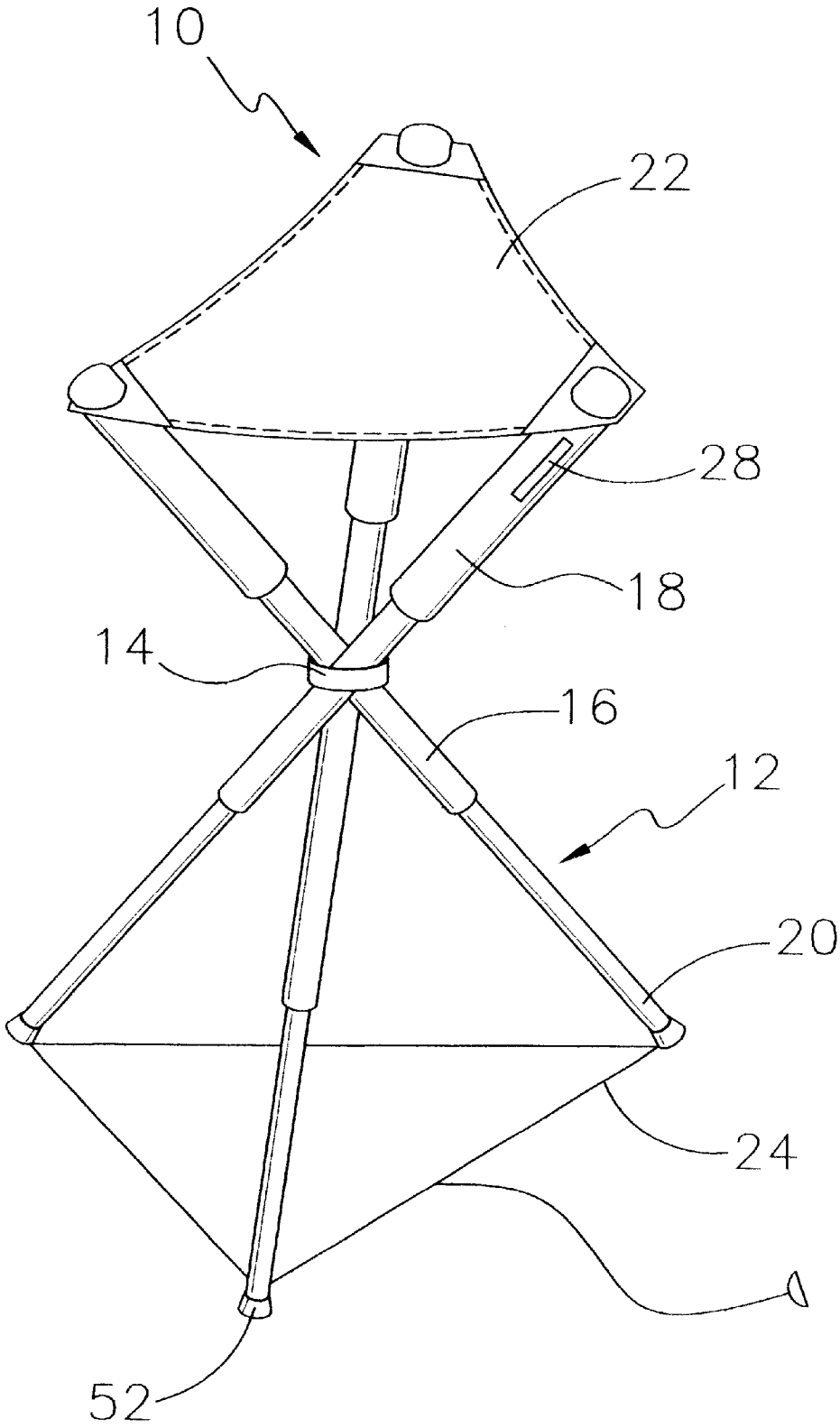
FIG. 1 is a perspective view of a new portable seating device according to the present invention.
Figure 2:
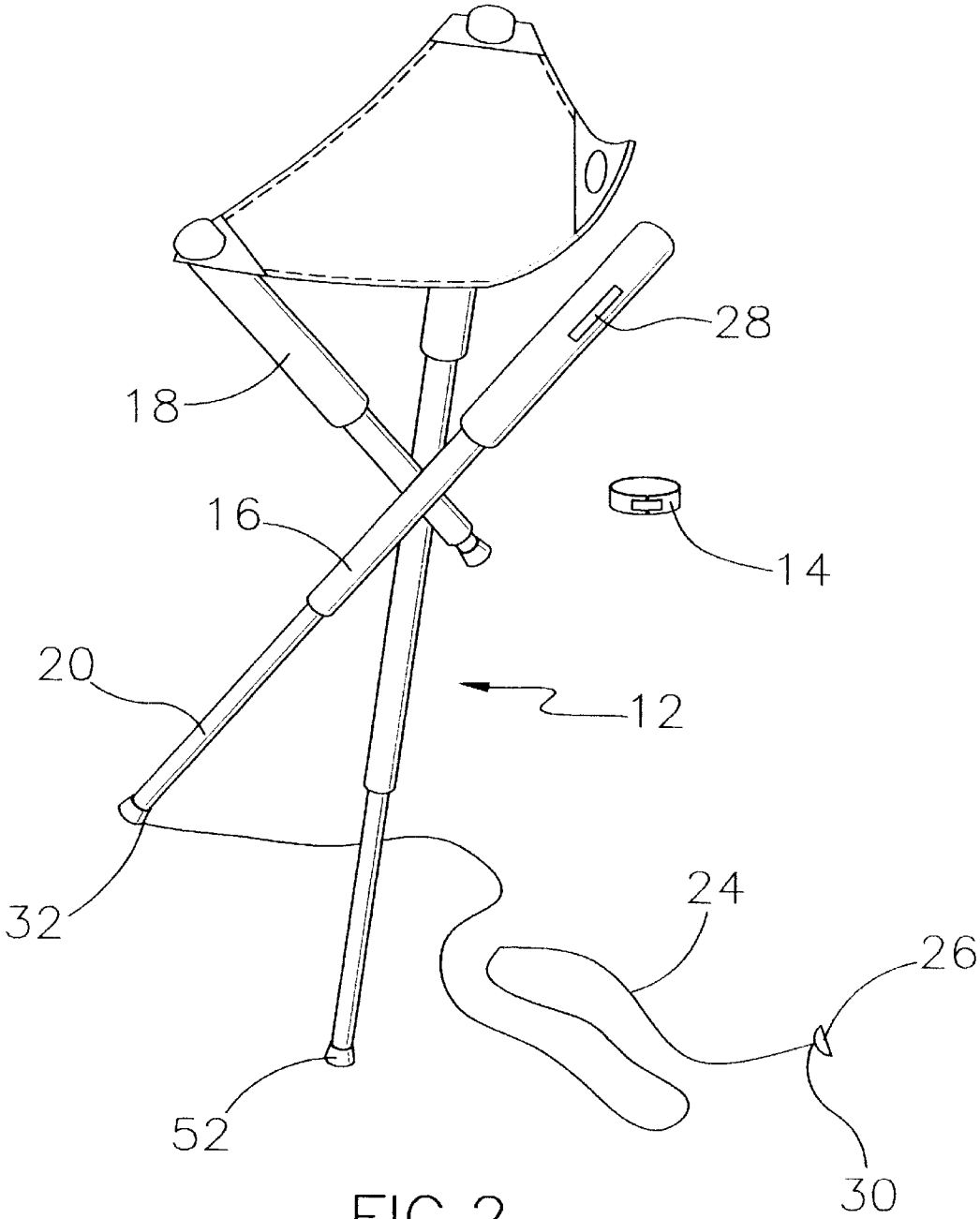
FIG. 2 is a perspective view of the present invention.
Figure 3:
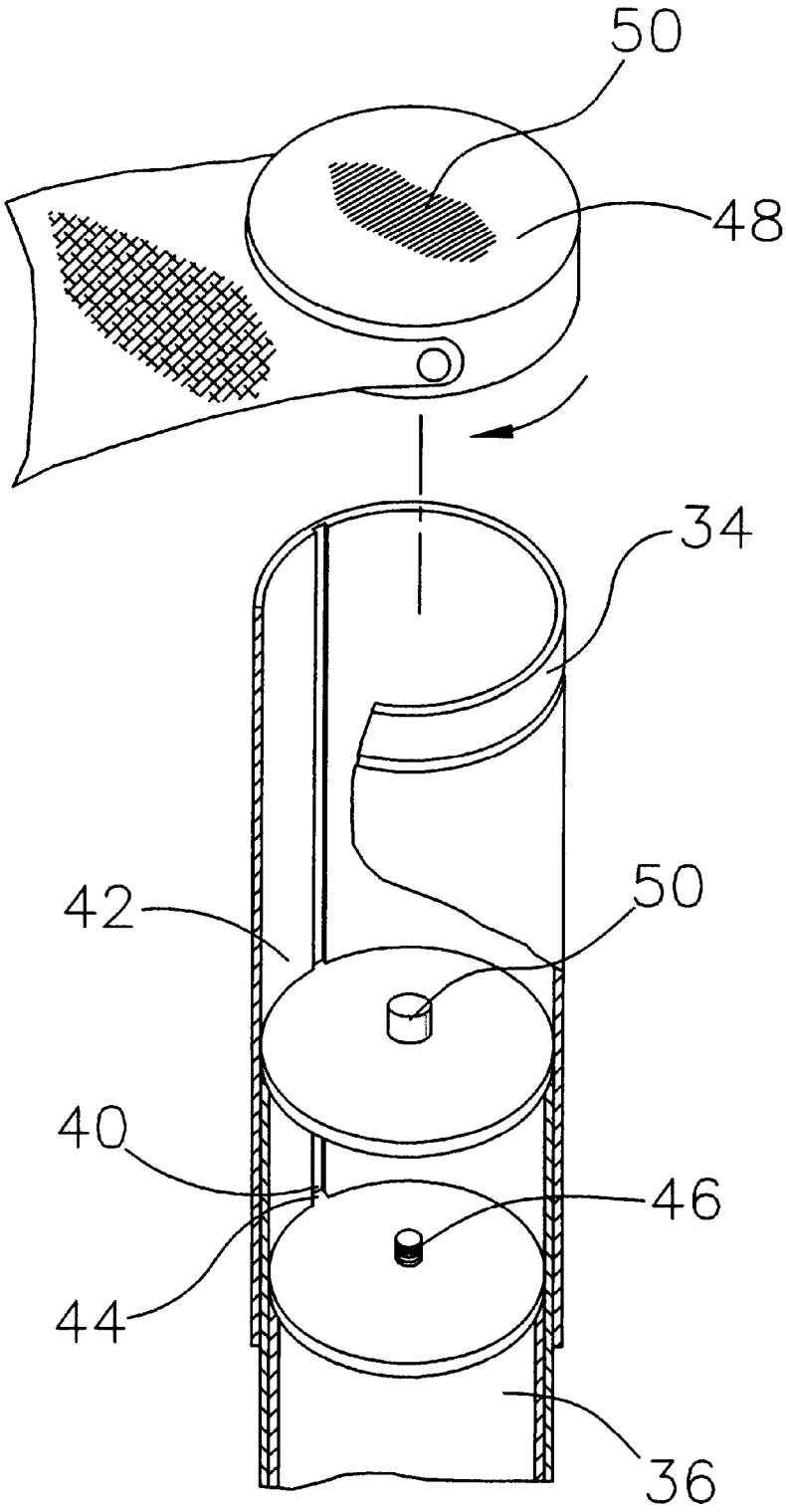
FIG. 3 is a cross-sectional view of the present invention.
Figure 4:
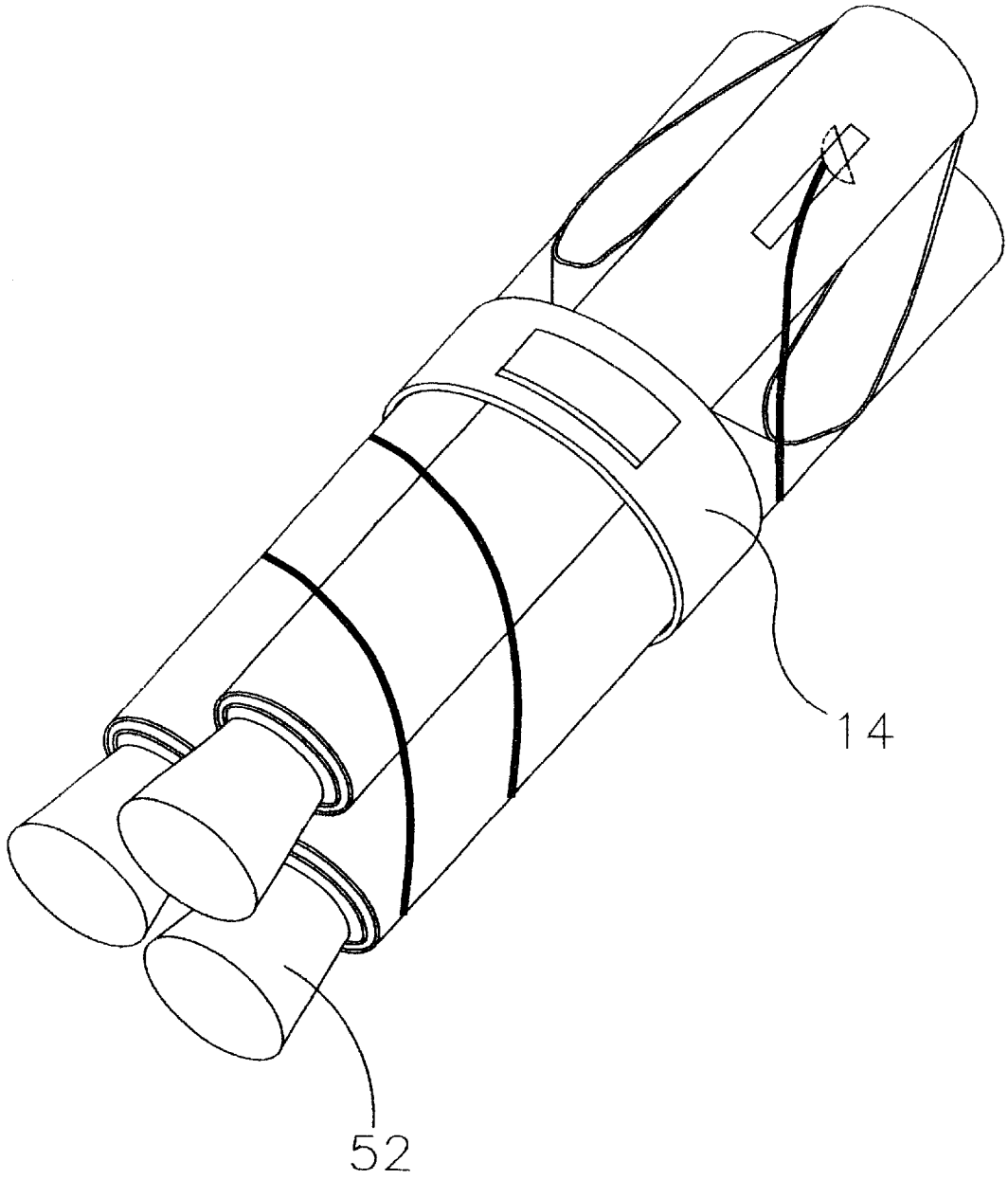
FIG. 4 is a perspective view of the present invention.

With reference now to the drawings, and in particular to FIGS. 1 through 4 thereof, a new portable seating device embodying the principles and concepts of the present invention and generally designated by the reference numeral 10 will be described.

As best illustrated in FIGS. 1 through 4, the portable seating device 10 generally comprises a plurality of telescoping legs 12. A band 14 is couplable to the plurality of legs 12 to hold the medial portions 16 of the telescoping legs 12 together to permit spreading of top 18 and bottom 20 portions of the plurality of legs 12 into a supporting position. A seat member 22 is couplable to the top portions 18 of the plurality of legs 12 such that the seat member 22 is held in a spread position when the plurality of legs 12 are in the supporting position whereby the seat member 22 is adapted for supporting a person sitting on the seat member 22. A line 24 is coupled to the bottom portion 20 of each of the plurality of legs 12 to form a loop for preventing the bottom portions 20 of the plurality of legs 12 from spreading beyond the supporting position.

A wire nut 26 is coupled to an end of the line 24. One of the plurality of legs 12 has a slot 28 for receiving the wire nut 26 whereby the end 30 of the line 24 is coupled to the one of the plurality of legs 12. A second end 32 of the line 24 is coupled to one of the plurality of legs 12 whereby the line 24 is wrappable around the plurality of legs 12 for holding the plurality of legs 12 together in a collapsed storage position. Each leg 12 of the plurality of legs 12 has an upper most portion 34 and a lowermost portion 36. A top of the lowermost portion 36 is couplable to a top of the uppermost portion 34 when each the leg 12 is in a retracted position for holding each the leg 12 in the retracted position. The uppermost portion 34 of each leg 12 has an uppermost portion 34 interior groove 38, a medial portion 16 of each the leg 12 has a medial portion interior groove 40.

The medial portion 16 has an exterior medial portion protrusion 42 positioned in the uppermost portion 34 interior groove 38. The lowermost portion 36 has an exterior lowermost portion protrusion 44 positioned in the medial portion interior groove 40 whereby the lowermost portion 36 is prevented from rotating relative to the uppermost portion 34. A threaded rod 46 extends from a top of the lowermost portion 36. A cap member 48 is coupled to a top of the uppermost portion 34. The cap member 48 has a threaded aperture 50 for receiving the threaded rod 46 whereby the lowermost portion 36 is secured to the cap member 48 to hold each the leg 12 in the retracted position. A plurality of rubber feet 52, each is coupled to an associated one of the plurality of legs 12.

In use, a user would lock in the extended position, they would be crossed together to form a tripod. They would then be bound together using a clasp that also is used to hold the chair together in the collapsed position.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible tripod seat assembly comprising:

a plurality of telescoping legs;

a band couplable to said plurality of legs to hold medial portions of said telescoping legs together to permit spreading of top and bottom portions of said plurality of legs into a supporting position;

a seat member couplable to said top portions of said plurality of legs such that said seat member is held in a spread position when said plurality of legs are in said supporting position whereby said seat member is adapted for supporting a person sitting on said seat member;

a line coupled to said bottom portion of each of said plurality of legs to form a loop for preventing said bottom portions of said plurality of legs from spreading beyond said supporting position;

each leg of said plurality of legs having an upper most portion and a lowermost portion, a top of said lowermost portion being couplable to a top of said uppermost portion when each said leg is in a retracted position for holding each said leg in said retracted position;

said uppermost portion of each said leg having an uppermost portion interior groove, a medial portion of each said leg having a medial portion interior groove;

said medial portion having an exterior medial portion protrusion positioned in said uppermost portion interior groove, said lowermost portion having an exterior lowermost portion protrusion positioned in said medial portion interior groove whereby said lowermost portion is prevented from rotating relative to said uppermost portion;

a threaded rod extending from a top of said lowermost portion;

a cap member coupled to a top of said uppermost portion, said cap member having a threaded aperture for receiving said threaded rod whereby said lowermost portion is secured to said cap member to hold each said leg in said retracted position.

2. The collapsible tripod seat assembly of claim 1, further comprising:

a wire nut coupled to an end of said line;

one of said plurality of legs having a slot for receiving said wire nut whereby said end of said line is coupled to said one of said plurality of legs; and a second end of said line being coupled to one of said plurality of legs whereby said line is wrappable around said plurality of legs for holding said plurality of legs together in a collapsed storage position.

3. The collapsible tripod seat assembly of claim 1, further comprising:

a plurality of rubber feet, each of said rubber feet being coupled to an associated one of said plurality of legs.

4. A collapsible tripod seat assembly comprising:

a plurality of telescoping legs;

a band couplable to said plurality of legs to hold medial portions of said telescoping legs together to permit spreading of top and bottom portions of said plurality of legs into a supporting position;

a seat member couplable to said top portions of said plurality of legs such that said seat member is held in a spread position when said plurality of legs are in said supporting position whereby said seat member is adapted for supporting a person sitting on said seat member;

a line coupled to said bottom portion of each of said plurality of legs to form a loop for preventing said bottom portions of said plurality of legs from spreading beyond said supporting position;

a wire nut coupled to an end of said line;

one of said plurality of legs having a slot for receiving said wire nut whereby said end of said line is coupled to said one of said plurality of legs;

a second end of said line being coupled to one of said plurality of legs whereby said line is wrappable around said plurality of legs for holding said plurality of legs together in a collapsed storage position;

each leg of said plurality of legs having an upper most portion and a lowermost portion, a top of said lowermost portion being couplable to a top of said uppermost portion when each said leg is in a retracted position for holding each said leg in said retracted position;

said uppermost portion of each said leg having an uppermost portion interior groove, a medial portion of each said leg having a medial portion interior groove;

said medial portion having an exterior medial portion protrusion positioned in said uppermost portion interior groove, said lowermost portion having an exterior lowermost portion protrusion positioned in said medial portion interior groove whereby said lowermost portion is prevented from rotating relative to said uppermost portion;

a threaded rod extending from a top of said lowermost portion;

a cap member coupled to a top of said uppermost portion, said cap member having a threaded aperture for receiving said threaded rod whereby said lowermost portion is secured to said cap member to hold each said leg in said retracted position; and a plurality of rubber feet, each of said rubber feet being coupled to an associated one of said plurality of legs.

* * * * *